US009302520B2

(12) United States Patent
Oshima

(10) Patent No.: US 9,302,520 B2
(45) Date of Patent: Apr. 5, 2016

(54) STAMP FACE FORMING DEVICE, METHOD OF FORMING STAMP FACE, AND NON-TRANSITORY STORAGE MEDIUM

(71) Applicant: CASIO COMPUTER CO., LTD., Tokyo (JP)

(72) Inventor: Kouji Oshima, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/508,255

(22) Filed: Oct. 7, 2014

(65) Prior Publication Data

US 2015/0096455 A1 Apr. 9, 2015

(30) Foreign Application Priority Data

Oct. 9, 2013 (JP) ..... 2013-212106

(51) Int. Cl.

| | |
|---|---|
| ***B41C 1/055*** | (2006.01) |
| ***B41C 3/06*** | (2006.01) |
| ***B41K 3/00*** | (2006.01) |
| *B41D 7/00* | (2006.01) |
| *B41K 1/00* | (2006.01) |

(52) U.S. Cl.

CPC . *B41K 3/00* (2013.01); *B41C 1/055* (2013.01); *B41C 3/06* (2013.01); *B41D 7/00* (2013.01); *B41K 1/00* (2013.01)

(58) Field of Classification Search

None

See application file for complete search history.

(56) References Cited

U.S. PATENT DOCUMENTS

| | | | | |
|---|---|---|---|---|
| 4,000,243 | A * | 12/1976 | Curren | 264/293 |
| 5,285,725 | A * | 2/1994 | Imamaki | B41N 1/248 101/127.1 |
| 5,595,112 | A * | 1/1997 | Seo | 101/26 |
| 5,829,352 | A * | 11/1998 | Taira et al. | 101/327 |
| 5,858,298 | A * | 1/1999 | Humal | 264/413 |
| 6,276,272 | B1 | 8/2001 | Takami et al. | |
| 6,341,561 | B1 * | 1/2002 | Imamaki et al. | 101/483 |
| 6,367,382 | B1 * | 4/2002 | Imamaki et al. | 101/405 |
| 6,460,456 | B1 * | 10/2002 | Sugiyama et al. | 101/327 |
| 2014/0020584 | A1 * | 1/2014 | Abe et al. | 101/333 |

FOREIGN PATENT DOCUMENTS

| | | | |
|---|---|---|---|
| JP | H10-100464 | A | 4/1998 |
| JP | 2000-127585 | A | 5/2000 |
| JP | 2002-103768 | A | 4/2002 |
| JP | 2012-153102 | A | 8/2012 |

* cited by examiner

*Primary Examiner* — Jill Culler

(74) *Attorney, Agent, or Firm* — Chen Yoshimura LLP

(57) ABSTRACT

A stamp face forming device, including: a stamp face forming unit that forms a stamp face on a stamp material while pressing the stamp material held on a stamp material holder; a conveying unit that causes the stamp material holder to move relative to the stamp face forming unit; and a support unit that supports the stamp material holder in order to prevent tilting of the stamp material holder with respect to a conveyance path for the stamp material holder of the stamp face forming unit, at least when the stamp face is being formed.

16 Claims, 8 Drawing Sheets

Details of II A

STAMP FACE FORMING DEVICE, METHOD OF FORMING STAMP FACE, AND NON-TRANSITORY STORAGE MEDIUM

BACKGROUND OF THE INVENTION

1. Field of the Invention

The present invention relates to a stamp face forming device, a method of forming a stamp face, and a non-transitory storage medium for forming a stamp face for a seal, a stamp, or the like.

2. Description of the Related Art

Conventionally, a seal, a stamp, or the like was known in which a porous sheet such as sponge rubber was used as the stamp material, the stamp material was impregnated with ink, and a seal impression was made by the stamp face made of this stamp material when the seal was pressed onto a surface.

As a stamp face forming device for forming such a stamp face, the device disclosed in Japanese Patent Application Laid-Open Publication No. H10-100464 is known. In this stamp face forming device, a stamp in which the stamp material is attached to a mount is fixed to the stamp face forming device, and the stamp material is conveyed while pressing it onto a stamp face forming unit (in this case, a thermal head). A heat-generating unit in the stamp face forming unit is selectively heated and a portion that is not ink-permeable and a portion that is ink-permeable are formed in the stamp material, thereby forming the stamp face in the stamp material.

In the stamp face forming device disclosed in Japanese Patent Application Laid-Open Publication No. H10-100464, a method is used in which the stamp face forming unit is pressed at a preset force onto the stamp material while moving the stamp face forming unit relative to the stamp material. If the surface on which the stamp face is formed including the stamp material changes, then there are cases in which the pressing force of the stamp face forming unit changes. For example, there was a problem that sometimes, in the vicinity of the edges of the area where the stamp face is formed, a portion of the stamp face forming unit is conveyed outside of the area where the stamp face is formed, and thus, the pressing state (pressing weight) of the stamp face forming unit onto the stamp material changes, and thus, the stamp face cannot be suitably formed. This phenomenon will be described in detail in the following embodiments.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a stamp face forming device including: a stamp face forming unit configured to press a stamp material held in a stamp material holder to form a stamp face in the stamp material; a conveying unit configured to move the stamp material holder relative to the stamp face forming unit along a conveyance path; and a support unit configured to support the stamp material holder in such a way as to cancel out a torque generated by a force applied by the stamp face forming unit to the stamp material holder that would cause the stamp material holder to tilt with respect to the conveyance path for the stamp material holder, at least when the stamp face is being formed.

In another aspect, the present disclosure provides a method of forming a stamp face including: pressing a stamp material held in a stamp material holder using a stamp face forming unit to form the stamp face in the stamp material; conveying the stamp material holder to move relative to the stamp face forming unit along a conveyance path when pressing the stamp material; and supporting the stamp material holder by a support unit in such a way as to cancel out a torque generated by a force applied by the stamp face forming unit to the stamp material holder that would cause the stamp material holder to tilt with respect to the conveyance path for the stamp material holder, at least when the stamp face is being formed.

In another aspect, the present disclosure provides a non-transitory storage medium stores therein a program to be read by a computer, the program causing the computer to control a stamp face forming device so as to perform the following process: pressing a stamp material held in a stamp material holder using a stamp face forming unit to form the stamp face in the stamp material; conveying the stamp material holder to move relative to the stamp face forming unit along a conveyance path when pressing the stamp material; and supporting the stamp material holder by a support unit in such a way as to cancel out a torque generated by a force applied by the stamp face forming unit to the stamp material holder that would cause the stamp material holder to tilt with respect to the conveyance path for the stamp material holder, at least when the stamp face is being formed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF EMBODIMENTS

A stamp face forming device of the present invention will be described with reference to an embodiment.

Figure 1A:
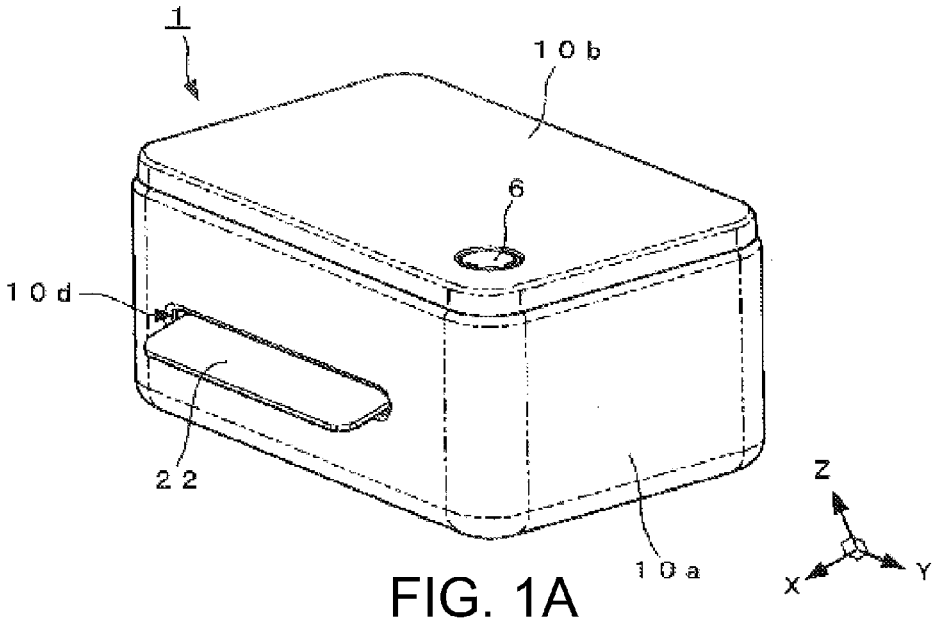
FIGS. 1A and 1B are schematic perspective views showing a stamp face forming device and a stamp face forming medium according to one embodiment of the present invention.
Figure 1B:
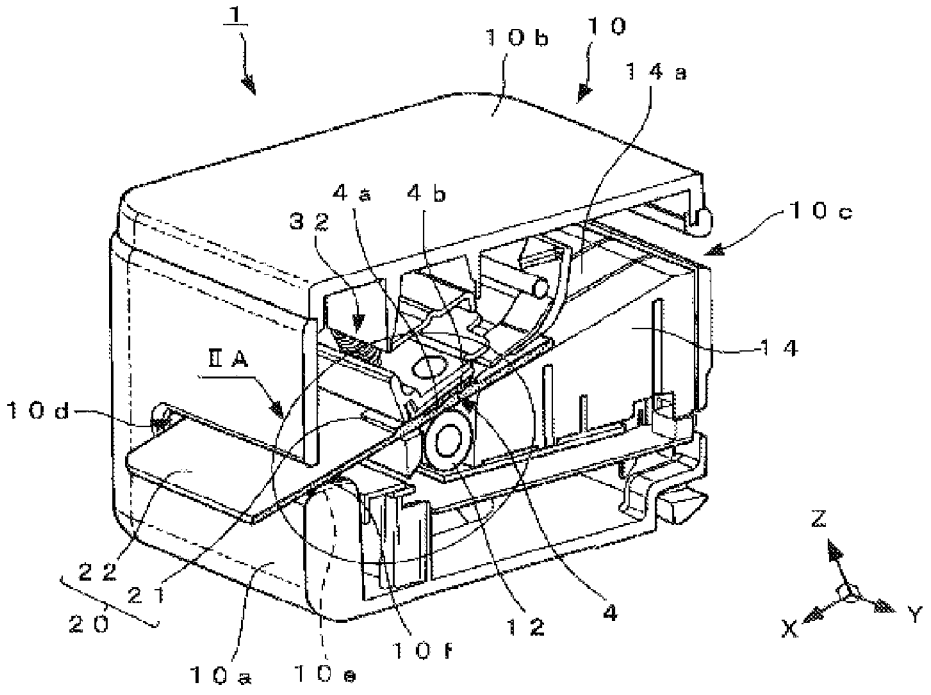
Figure 2A:
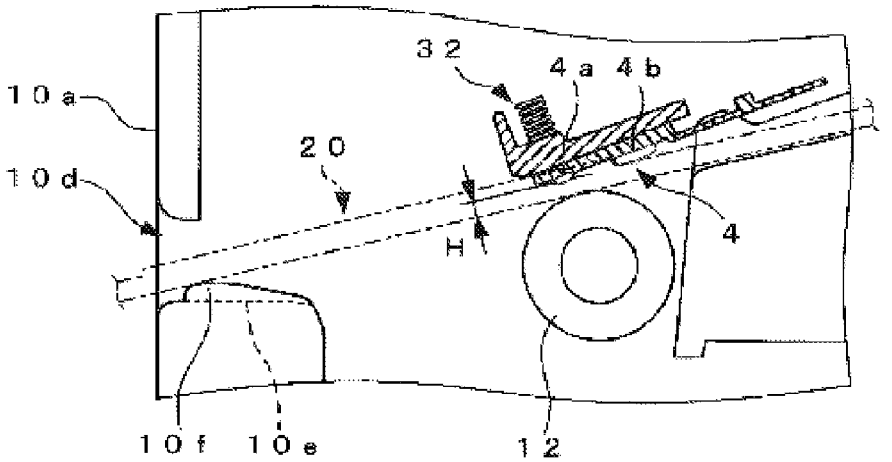
FIGS. 2A and 2B are schematic views showing the structure of an area around an exit hole of the stamp face forming medium of the stamp face forming device of the present embodiment.
Figure 2B:
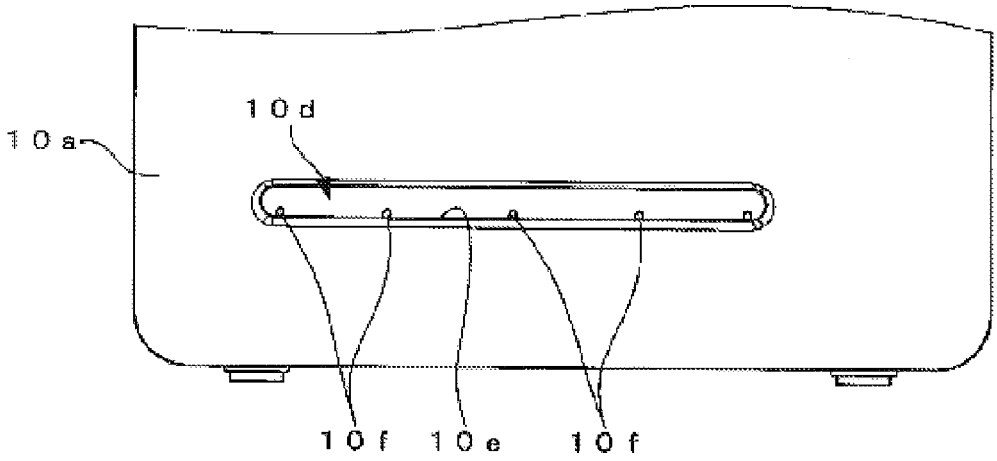
Figure 3:
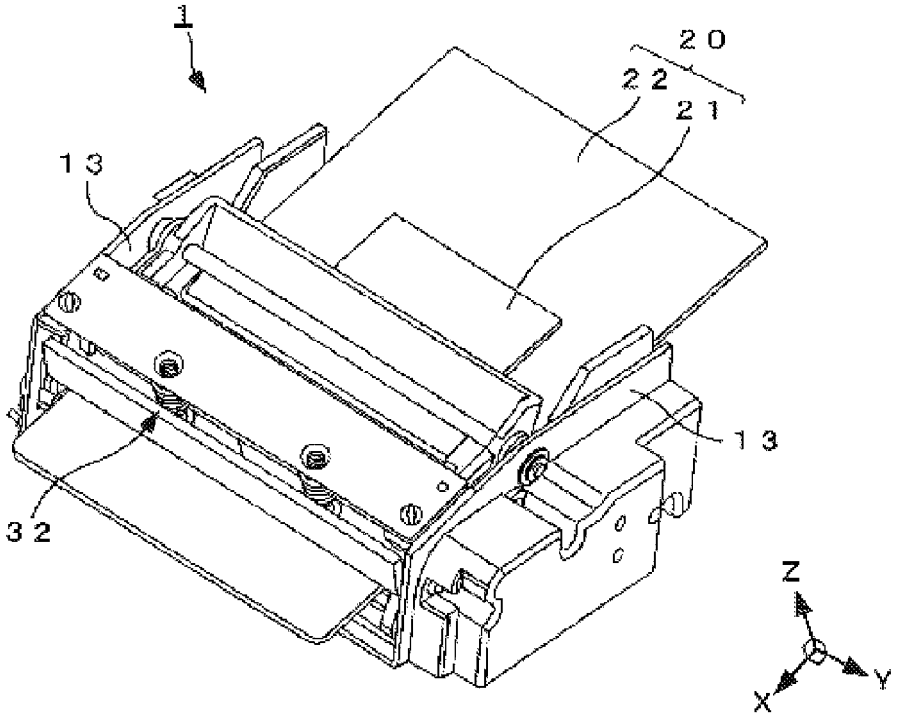
FIG. 3 is a perspective view that shows main components of a stamp face forming mechanism used in the stamp face forming device of the present embodiment.
Figure 4A:
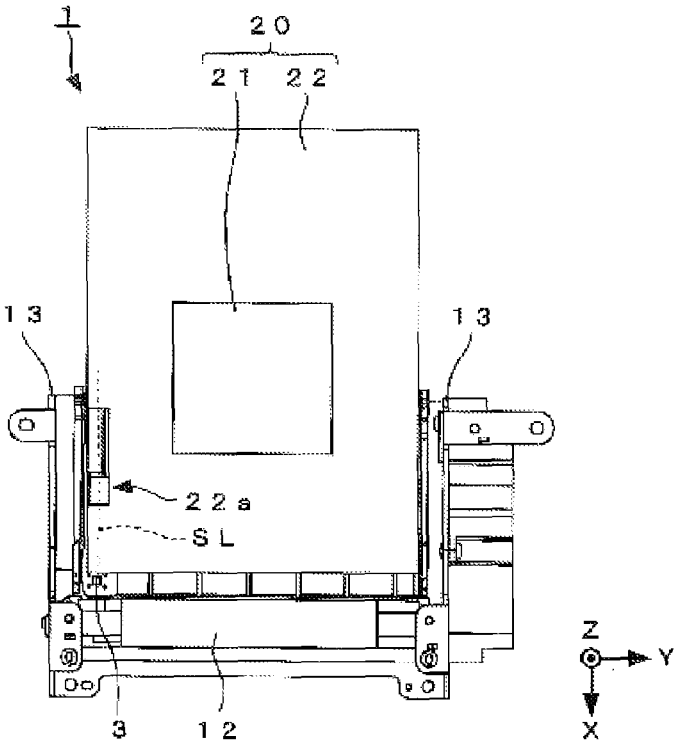
FIGS. 4A and 4B are respectively a plan view and a cross-sectional view of main components of the stamp face forming mechanism used in the stamp face forming device of the present embodiment.
Figure 4B:
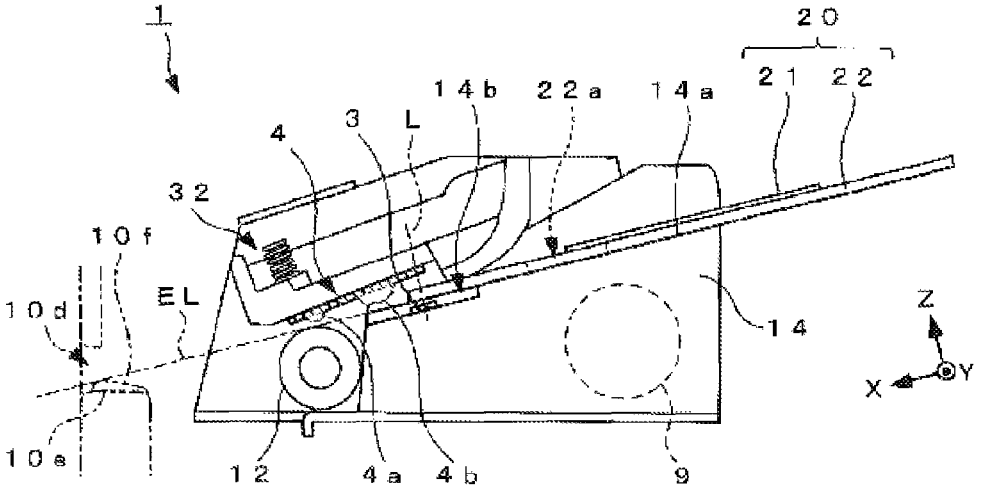

FIGS. 1A and 1B are schematic perspective views showing a stamp face forming device and a stamp face forming medium according to one embodiment of the present invention. Here, FIG. 1A is a schematic external view of the stamp face forming device of the present embodiment, and FIG. 1B is a schematic cross-sectional view showing a cross-sectional structure on a plane along a direction X-Z. FIGS. 2A and 2B are schematic views showing the structure of an area around an exit hole of the stamp face forming medium of the stamp face forming device of the present embodiment. FIG. 2A is a cross-sectional view of main portions showing a cross-sectional structure of a portion IIA shown in FIG. 1B (in the present specification, "II" in FIG. 1B will be used for convenience as the Roman numeral for "2," and similar notation will be used below), and FIG. 2B is a plan view showing an outer appearance of the stamp face forming device including an exit hole. FIG. 3 is a perspective view that shows main components of a stamp face forming mechanism used in the stamp face forming device of the present embodiment. FIGS. 4A and 4B are respectively a plan view and a cross-sectional view of main components of the stamp face forming mechanism used in the stamp face forming device of the present embodiment. Here, FIG. 4A is a plan view of the stamp face forming mechanism, and FIG. 4B is a schematic cross-sectional view showing the cross-sectional configuration on a plane along a direction X-Z.

The stamp face forming device 1 of the present embodiment (hereinafter referred to as a "printer") is a so-called thermal printer, and as shown in FIGS. 1A and 1B, for example, and a stamp face forming medium 20 (details will be described later, but the stamp face forming medium 20 has a stamp material 21 and a stamp material holder 22 that holds the stamp material 21; hereinafter referred to as a "medium") inserted from an insertion hole 10*c* is conveyed towards the exit hole 10*d*. The printer 1 forms a stamp face indicating a character, a symbol, or an image (the portion of the seal or stamp that, when pressed, leaves an impression such as a character, a symbol or an image) in the stamp material 21 of the medium 20 by pressing a thermal head 4 onto the moving medium 20 at a preset force and selectively heating a plurality of heat-generating units included in the thermal head 4.

For ease of understanding, in the description below, as shown in FIGS. 1A and 1B, X, Y, and Z directions that intersect perpendicularly with each other are designated. As for the reference characters X, Y, and Z indicating the directions in the drawings, the symbol "+" is added to indicate the direction of the arrow, the symbol "−" is added to indicate the direction opposite to the arrow, and if both directions are indicated, no symbol ("+" or "−") is added. The X direction is the same direction as the direction in which the object on which the stamp face is to be formed (medium 20) is conveyed, and is also referred to as the front/rear direction. The Y direction is the same direction as the width direction of the printer 1, and is also referred to as the left/right direction. The Z direction is the same direction as the direction in which the thermal head 4 is pressed onto the medium 20, and is also referred to as the up/down direction.

As shown in FIGS. 1A and 1B, the printer 1 includes a case 10 constituted of a lower case 10*a* and an upper case 10*b*, and an insertion hole 10*c* and an exit hole 10*d* for passing through the medium 20 are formed in the front and rear surfaces of the lower case 10*a*. The upper surface of the upper case 10*b* is provided with an input operation unit 6. If an operation is performed on the input operation unit 6 by an operator, then a signal based on the operation is outputted.

As shown in FIGS. 2A and 2B, for example, in the exit hole 10*d* of the lower case 10*a*, on a lower inner face 10*e* that is a portion forming the exit hole 10*d*, a plurality of ribs 10*f* (support unit) are formed to protrude at a predetermined height in the exit hole 10*d*, the ribs 10*f* being disposed along the direction of the opening (Y direction) of the exit hole 10*d* at a prescribed space from each other. Here, the plurality of ribs 10*f* are disposed on the path in which the medium 20 exiting through the exit hole 10*d* is conveyed. In other words, the plurality of ribs 10*f* are provided to be in contact with and support a rear surface side of the medium 20 (surface on the side opposite to that where the thermal head 4 is pressed and the stamp face is formed; lower side in drawing) in the vicinity of one end (in the +X direction) of the medium 20 when the medium 20 is inserted through the insertion hole 10*c* and conveyed inside the printer 1 at least at a point when switching from a state in which the thermal heads 4 are pressed on the medium 20 to a certain specified state. At this time, the plurality of ribs 10*f* are provided to be in contact with the rear surface of the medium 20 such that the medium 20 does not bend (change shape), and it is more preferable that the plurality of ribs 10 be provided so as not to affect the conveyance (speed at which the medium 20 is fed) of the medium 20 and so as to support the medium 20 while being in light contact therewith with little friction, for example.

As shown in FIGS. 3, 4A, and 4B, for example, the stamp face forming mechanism included in the case 10 of the printer 1 mainly includes a thermal head 4 (stamp face forming unit), a stepping motor 9, a guide 14, and a platen roller 12 (conveyance roller). On both ends of the thermal head 4, the guide 14, and the platen roller 12, a pair of plate-shaped side frames 13 facing each other in the Y direction is provided.

As shown in FIGS. 3, 4A, and 4B, the platen roller 12 conveys the medium 20 in the X direction, and is disposed across the space between the side frames 13, both ends of the platen roller 12 penetrating the side frames 13. Both ends of the platen roller 12 are supported by the side frame 13 so as to rotate freely with respect to the side frames 13. The +Y end of the rotational axis of the platen roller 12 has integrally formed thereon a roller gear (not shown), for example, and the platen roller 12 rotates at a predetermined rotational speed as a result of drive power from the rotation of a drive gear provided on a drive axis of the stepping motor 9 being transferred to the platen roller 12 through a plurality of transmission gears.

The guide 14 has formed thereon an inclined surface 14*a* for guiding the medium 20 (stamp material 21) to the platen roller 12. The inclined surface 14*a* is disposed such that an extension line EL (shown as a one dot chain line in the drawing; corresponds to a conveyance path) drawn from the inclined surface 14*a* contacts the circumferential surface of the platen roller 12 when seen in the Y direction view shown in FIG. 4B (cross-section viewed from the +Y direction). Here, as shown in FIG. 4B, the ribs 10*f* provided on the inner face 10*e* of the exit hole 10*d* described above are set at a protrusion height, shape, and position such that the upper faces of the ribs 10*f* touch the extension line EL.

As shown in FIG. 4B, a recess 14*b* of the inclined surface 14*a* is provided with a sensor 3. The sensor 3 is provided slightly towards the −Z direction from the rear surface path of the medium 20 so as not to come into contact with the medium 20. In the Z direction view shown in FIG. 4A (plan view seen from the +Z direction), the sensor 3 is disposed slightly towards the −X direction compared to the platen roller 12 that is slightly to the +Y direction compared to the left side frame 13 such that a cutout 22*a* of the medium 20 passes over the sensor 3. A detection scan line SL indicated with the broken line in FIG. 4A is a line that extends in the X direction and intersects with an optical axis L of the sensor 3. The sensor 3 is a reflective optical sensor, and has a light-emitting element that emits light in the +Z direction, and a light-receiving element that receives light reflected towards the −Z direction after hitting an object to be sensed (in this case, the medium 20). The sensor 3 outputs a signal based on the amount of light received by the light-receiving element. Based on this signal, the type (size) of the stamp material 21 embedded in the medium 20 is determined.

As shown in FIGS. 2A and 4B, the thermal head 4 is provided to face the platen roller 12. The thermal head 4 presses the stamp material 21 of the medium 20 conveyed in the X direction. A pressing portion 4*a* of the thermal head 4 that presses the stamp material 21 is provided in a straight line belt shape along the Y direction. Here, the length of the pressing portion 4*a* (length in the Y direction) is set to be greater than the width of the stamp material 21 (length in the Y direction). As a result, the straight line belt shaped portion extending in the width direction of the stamp material 21 changes evenly in shape by being pressed by the pressing portion 4*a*. On the pressing portion 4*a*, a plurality of heat-generating units (not shown) that are selectively heated when forming the stamp face are arranged along the direction in which the pressing portion 4*a* extends (Y direction). Also, the thermal head 4 is provided with an IC chip 4*b* (driver IC) including a driver circuit for controlling the heating state of the respective plurality of heating units arranged in the pressing portion 4*a*. The driver IC 4*b* is disposed in a position in a direction opposite to the direction of conveyance of the medium 20, for example (−X direction), with respect to the pressing portion 4*a* provided with the plurality of heating units. With such a configuration, the portion of the stamp material 21 having the straight line belt shape (portion to be deformed by being pressed by the pressing portion 4*a*) is heated in portions corresponding to the heating units, which emit heat.

Here, a general thermal head 4 includes the pressing portion 4*a* provided with the plurality of heating units, and the driver IC 4*b* for controlling the heating state of the heating units, on one side of a printed circuit board (PCB). This is a configuration to reduce the size of the printed circuit board and to mitigate an increase in cost, and almost all general purpose products have this form.

The gap between the thermal head 4 and the platen roller 12 (represented by "H" in FIG. 2A) may be set to a preset uniform width, or a mechanism (represented by "32" in FIG. 2A) may be provided to move the thermal head 4 or the platen roller 12 in the Z direction so as to adjust the gap H between the thermal head 4 and the platen roller 12 based on the configuration of the medium 20 to be described below. By using such an adjusting mechanism 32 to adjust the gap H between the thermal head 4 and the platen roller 12, it is possible to change the pressing force of the thermal head 4 onto the stamp material 21. In particular, in a case in which a stamp face is formed on media 20 having differing stamp material 21 sizes (particularly in the width direction), the pressing state of the pressing portion 4*a* of the thermal head 4 sometimes changes depending on the size of the stamp material 21, and thus, the adjusting mechanism 32 that adjusts the gap H between the thermal head 4 and the platen roller 12 is well suited to appropriately forming the stamp face. In the adjusting mechanism 32 to adjust the gap H, by scanning the cutout 22*a* of the medium 20 using the sensor 3, for example, the gap H is adjusted based on the size of the stamp material 21 of the medium 20 determined by the control unit 2. Here, the smaller the gap H is set, the greater the pressing force of the thermal head 4 onto the stamp material 21.

Next, the functional configuration of the printer 1 of the present embodiment will be described.

Figure 5:
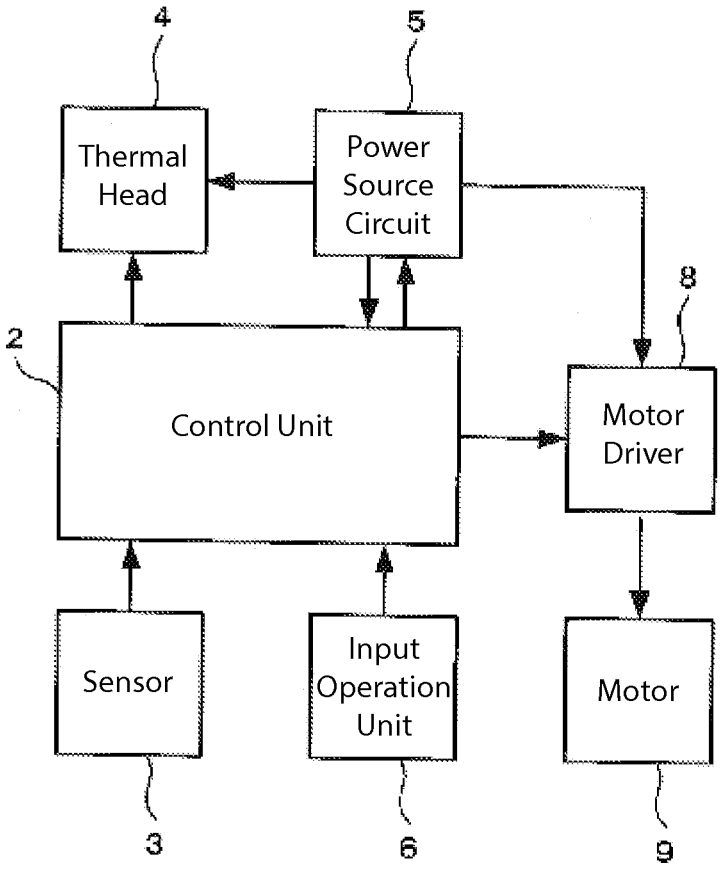
FIG. 5 is a block diagram showing one example of a functional structure of a printer of the present embodiment.

FIG. 5 is a block diagram showing one example of a functional structure of a printer of the present embodiment.

As shown schematically in FIG. 5, the printer 1 includes: the control unit 2, the sensor 3, the thermal head 4, a power source circuit 5, an input operation unit 6, a motor driver 8, and a stepping motor 9 ("motor" in the drawing).

The control unit 2 is constituted of a microcomputer including a CPU (central processing unit), RAM (random access memory), ROM (read only memory), a UI (user interface), and the like. The control unit 2 is connected to the sensor 3, the thermal head 4, the power source circuit 5, the input operation unit 6, and the motor driver 8. The motor driver 8 is connected to the stepping motor 9. The control unit 2 controls the entire printer 1 according to a control program stored in the ROM on the basis of signals from the sensor 3, the input operation unit 6, and the like. The control unit 2 receives image data from an external device such as a personal computer or a smartphone through an interface that is not shown in the drawing. The control unit 2 forms a stamp face based on the image data, and forms a stamp face showing an image (character, symbol, or image) indicated by the image data onto the stamp material 21.

The power source circuit 5 is a power source IC (integrated circuit) and supplies power necessary for the respective circuits in the printer 1.

The thermal head 4 receives data and a print signal outputted from the control unit 2 and controls the current dots by the driver IC 4*b* (see FIGS. 2A and 4B) provided in the head. As a result, the heat-generating units in the thermal head 4 are selectively heated based on the image data. Power necessary to heat the heat-generating units of the thermal head 4 is supplied by the power source circuit 5.

The motor driver 8 receives a drive signal outputted by the control unit 2 and sends an excitation signal for driving to the stepping motor 9. The drive power of the stepping motor 9 is supplied from the power source circuit 5. Here, the control unit 2 calculates how much the stepping motor 9 has been rotated by counting the number of pulses in the signal outputted by the motor driver 8. In other words, the control unit 2 calculates the distance of conveyance by the platen roller 12 on the basis of the number of pulses counted. The calculation of the distance of control unit by the platen roller 12 in the control unit 2 may be performed by a method other than counting the number of pulses. For example, the number of rotations of the platen roller 12 may be counted by a rotary encoder to calculate the distance of conveyance by the platen roller 12 based on the number of rotations detected.

Next, the medium 20 on which the stamp face is formed by the printer 1 will be described.

Figure 6A:
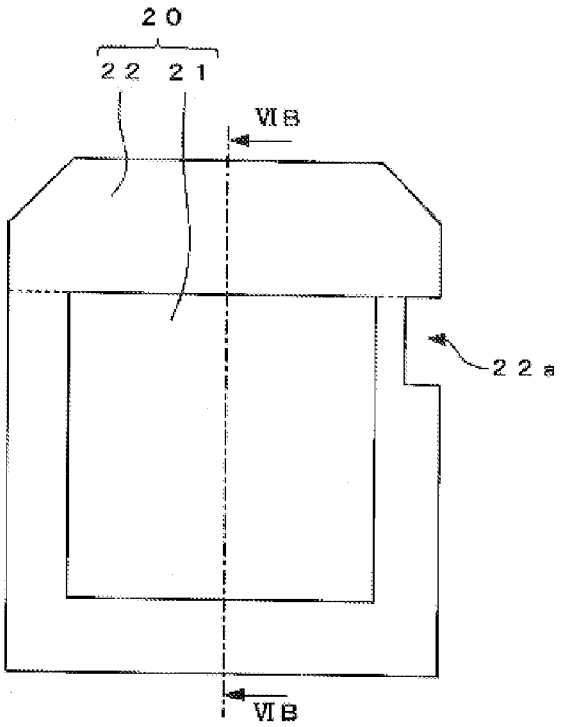
FIGS. 6A, 6B, and 6C are schematic views showing one example of a stamp face forming medium in which a stamp face is formed by the printer of the present embodiment.
Figure 6B:
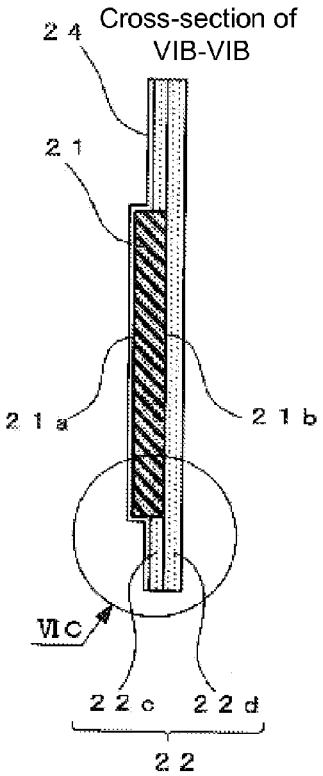
Figure 6C:
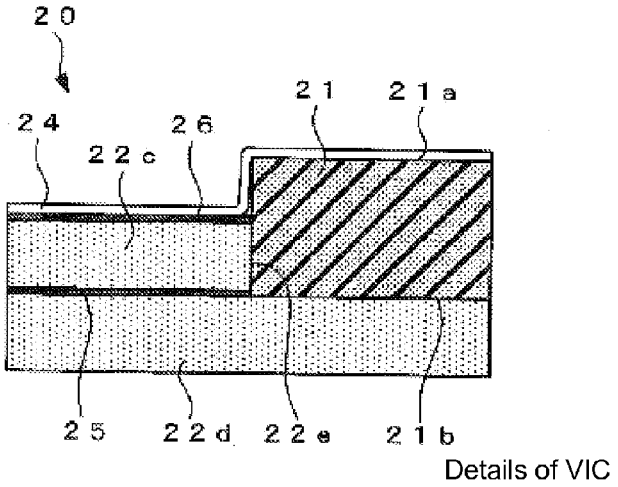
Figure 7A:
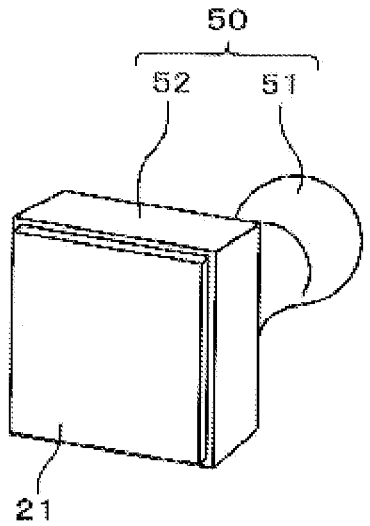
FIGS. 7A and 7B are schematic views showing one example of a seal to which the stamp material having the stamp face formed therein is attached.
Figure 7B:
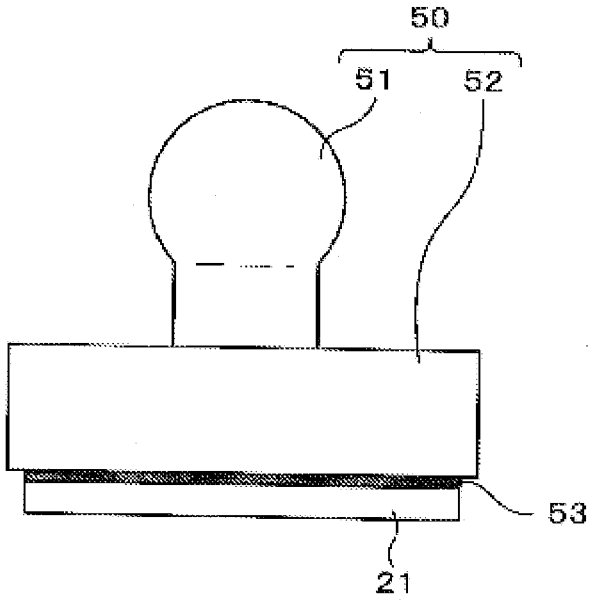

FIGS. 6A, 6B, and 6C are schematic views showing one example of a medium in which a stamp face is formed by the printer of the present embodiment. Here, FIG. 6A is a plan view showing a stamp face forming side of the medium, FIG. 6B is a schematic cross-sectional view showing a cross-sectional configuration along the line VIB-VIB shown in FIG. 6A (in the present specification, "VI" in FIG. 6A will be used for convenience as the Roman numeral for "6," and similar notation will be used below), and FIG. 6C is a cross-sectional view of main portions showing a cross-sectional configuration in the VIC portion shown in FIG. 6B. FIGS. 7A and 7B are schematic views showing one example of a seal to which the stamp material having the stamp face formed therein is attached. Here, FIG. 7A is a perspective view of a seal as viewed from the stamp material side, and FIG. 7B is a side view of the seal.

As described above, the medium 20 has a stamp material 21, and a stamp material holder 22 that holds the stamp material 21. As shown in FIGS. 6A and 6B, the stamp material holder 22 holds the stamp material 21 in the center thereof.

The stamp material 21 has a main surface 21*a* to be the actual stamp face. The stamp material 21 is made of a porous sponge into which liquid ink can permeate, and is made of a porous ethylene-vinyl acetate copolymer (hereinafter referred to as "EVA"), and is deformable. The EVA has many air bubbles, and ink enters these air bubbles.

The stamp material holder 22 is a tool used when forming a stamp face on the above-mentioned stamp material 21, and is separated and discarded (or reused) after the formation of the stamp face. As shown in FIGS. 6B and 6C, the stamp material holder 22 is configured by bonding together an upper paperboard 22*c* and a lower paperboard 22*d* made of chipboard. As shown in FIG. 6A, one side portion of the stamp material holder 22 (right side) has a cutout 22*a* formed therein. The stamp material holder 22 has a white surface, for example, in order to reflect light from the sensor 3 at a high reflectance.

As shown in FIGS. 6B and 6C, the upper paperboard 22*c* has a positioning hole 22*e* for fixing in the center thereof the stamp material 21. The stamp material 21 is fitted into the positioning hole 22*e* and fixed therein. As shown in FIGS. 6A and 6B, the lower paperboard 22*d* has the same outer shape as the upper paperboard 22*c* but does not have a positioning hole 22*e*. When the lower paperboard 22*d* and the upper paperboard 22*c* are bonded together, the lower paperboard 22*d* is in contact with the entire rear surface 21*b* of the stamp material 21.

As shown in FIGS. 6B and 6C, the main surface 21*a* (left-side surface in FIG. 6B or upper surface in FIG. 6C) of the stamp material 21 protrudes slightly from the upper surface (left-side surface in FIG. 6B or upper surface in FIG. 6C) of the upper paperboard 22*c*. In the present embodiment, the combined thickness of the upper paperboard 22*c* and the lower paperboard 22*d* is set to 1.2 mm, for example, and the thickness of the entire medium 20 is set to 1.8 mm, for example. In other words, in this example, the stamp material 21 protrudes by 0.6 mm from the upper paperboard 22*c*.

As shown in FIGS. 6B and 6C, the medium 20 has a film 24 that covers the upper surface of the stamp material holder 22 and the upper face of the stamp material 21. The film 24 has a base material such as PET (polyethylene terephthalate) or polyimide, and has heat durability, heat conductivity, and surface smoothness. The heat durability of the film 24 is set to be higher than the temperature of the thermal head 4 during formation of the stamp face and higher than the melting point of the stamp material 21. The heat conductivity of the film 24 is set such that the heat of the thermal head 4 during formation of the stamp face is transferred to the stamp material 21, and the stamp material 21 is melted to an appropriate degree. The surface smoothness of the film 24 is set such that the pressing portion 4*a* of the thermal head 4 in contact with the film 24 during formation of the stamp face slides past the film without much friction.

As shown in FIG. 6C, the upper paperboard 22*c* and the lower paperboard 22*d* are bonded together by a double-sided adhesive sheet 25, for example. The film 24 is bonded by a double-sided adhesive sheet 26 to the surface surrounding the stamp material holder 22, or in other words, the surface of the upper paperboard 22*c* into which the stamp material 21 fits.

In FIGS. 6A, 6B, and 6C, an example of a medium 20 on which the stamp face is formed in the printer 1 of the present embodiment was described, but it is possible to form a stamp face in a plurality of types of media 20 having differing sizes of stamp materials 21 (vertical dimension and horizontal dimension in FIG. 6A). Here, the thickness and width (horizontal dimension of FIG. 6A) of the various types of media 20 is set to be the same, and the lengths of the media 20 (vertical dimension of FIG. 6A) are set to be different depending on the size of the stamp material 21. A cutout 22*a* is formed in the stamp material holder 22 to correspond one-to-one in size to the stamp material 21 of the various types of media 20 such that the size of the cutout 22*a* depends on the size of the stamp material 21. The cutouts 22*a* of the stamp material holders 22 are scanned by the sensor 3 of the printer 1, and by detecting the size, the type (size) of the stamp material 21 of the medium 20 is determined.

The stamp material 21 is removed from the stamp material holder 22 after formation of the stamp face (details below) is completed in the printer 1. As shown in FIGS. 7A and 7B, the removed stamp material 21 is attached by a double-sided adhesive sheet 53 or the like to the bottom surface (surface on lower side of mount 52 in FIG. 7B) of a rectangular mount 52 of a seal 50, which is constituted of a spherical handle 51 and the mount 52.

Next, the principles by which the stamp face is formed in the stamp material will be described in a simple manner.

As described above, the stamp material 21 is made of EVA. EVA is a thermosetting material, and thus, when heated up to 70° C. to 120° C., for example, the heated portions soften, and once the softened portions cool, they are cured. The air bubbles in the cured portions are filled, which makes them non-porous, thus not allowing ink to permeate therethrough.

The printer 1 of the present embodiment heats appropriate locations on the surface of the EVA using the thermal head for approximately 1 msec to 5 msec to make appropriate locations on the surface of the EVA non-porous, relying on the characteristics of the stamp material 21 (EVA), and thus, it is possible to prevent the permeation of ink in these portions. The stamp material 21 is cut in advance to a predetermined rectangular shape by a heat cutter. Thus, none of the four side faces of the stamp material 21 allow ink to permeate therethrough. The rear surface 21*b* of the stamp material 21 is also heated, and therefore, does not allow ink to permeate therethrough. Thus, ink is prevented from seeping from surfaces other than the main surface 21*a*, which is to become the stamp face surface.

During formation of the stamp face (heat printing), portions into which ink permeates are not heated, and portions where ink is not to permeate are heated, and thus, it is possible to form ink-permeable portions based on a desired image for when the stamp is pressed. Taking into account the margin of error when forming the stamp face and that ink does not permeate through the stamp material 21, the size of the stamp material 21 is made to be slightly larger than the size of the image. For example, if the size of the image is 30 mm×30 mm, then the size of the stamp material 21 is set to 32 mm×32 mm.

Next, in the printer 1 of the present embodiment, the operation of forming the stamp face will be described. The respective functions listed in the process flow below are stored as a readable program code in the control unit 2, and operations according to the program code are executed consecutively.

Figure 8A:
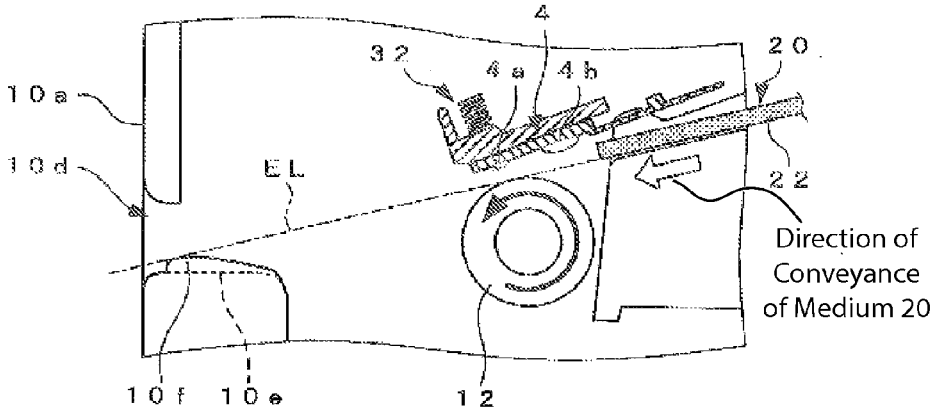
FIGS. 8A, 8B, and 8C are schematic cross-sectional views showing a state in which the stamp face is formed by the printer of the present embodiment.
Figure 8B:
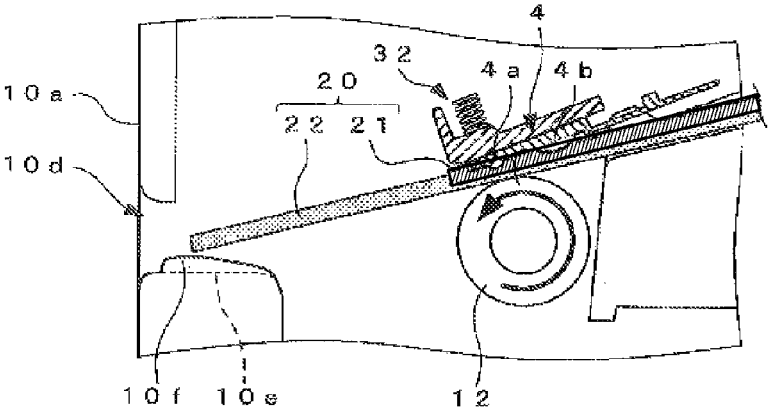
Figure 8C:
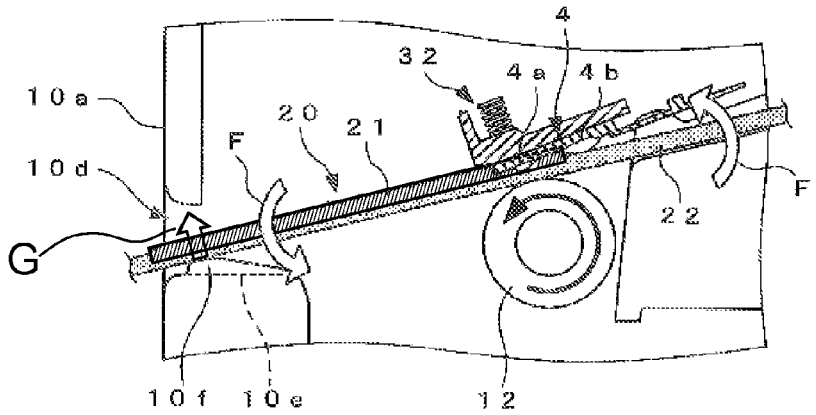

FIGS. 8A, 8B, and 8C are schematic cross-sectional views showing a state in which the stamp face is formed by the printer of the present embodiment.

As for the operation of forming the stamp face in the printer 1, first, the control unit 2 executes a process of initializing the printer 1 if the input operation unit 6 is pressed and a signal to start up the printer 1 is inputted from the input operation unit 6. The initialization of the printer 1 is performed by the control unit 2 transmitting a drive signal to the motor driver 8 and causing the stepping motor 9 to rotate for a predetermined period of time. As a result, the platen roller 12 rotates for the predetermined period of time, and even if the medium 20 remains in the printer 1, the medium 20 is expelled through the exit hole 10*d* to outside of the printer 1.

After initialization is completed, as shown in FIG. 8A, the control unit 2 causes the stepping motor 9 to rotate and therefore the platen roller 12 to rotate if a start signal to start formation of the stamp face (for example, a signal outputted from the input operation unit 6 after initialization indicating that the input operation unit 6 has been pressed) is received from the input operation unit 6 in a state in which an operator of the printer 1 has inserted the medium 20 from the insertion hole 10*c* into the printer 1. As a result, the medium 20 is conveyed in the +X direction along the guide 14 (inclined surface 14*a*).

Here, if the stamp face is to be formed on various types (sizes) of media, then the control unit 2 detects the length of the cutout 22*a* of the medium 20 (stamp material holder 22) using the sensor 3, and determines the type of medium 20 (size of the stamp material 21). The control unit 2 then controls the adjusting mechanism 32 to adjust the gap H between the thermal head 4 and the platen roller 12 on the basis of the detected type of medium 20, and sets the gap H based on the type of medium 20. As a result, the pressing force of the thermal head 4 onto the stamp material 21 is appropriately adjusted depending on the type of medium 20.

As shown in FIG. 8B, when the medium 20 is further conveyed in the +X direction, the pressing portion 4*a* of the thermal head 4 passes over the upper surface of the stamp material holder 22 to reach to the stamp material 21. The stamp material 21 of the medium 20 is pulled below the thermal head 4, conveyed while being pressed at a predetermined pressing force, and the stamp face is formed therein due to heat received from the heat-generating units arranged along the Y direction of the pressing portion 4*a* of the thermal head 4.

Specifically, the control unit 2 performs control based on the inputted image data while coordinating the conveyance of the medium 20 (rotation of the stepping motor 9) and the heating of specific heat-generating units among the plurality of heat-generating units of the thermal head 4, and by selectively heating positions of the stamp material 21 based on the image data to form ink-permeable and non-ink-permeable portions based on image data, the stamp face is formed.

At this time, as described above, the EVA used in the stamp material 21 is a porous spongy material that is very soft, and thus, in order to perform appropriate formation of the stamp face (heat printing), the heat-generating units of the thermal head 4 need to be pressed onto the stamp material 21 of the medium 20 with even greater force than normally used in a printer that performs heat-printing. For this reason, as shown in FIGS. 6B and 6C, the main surface 21*a* of the stamp material 21 protrudes from the upper surface of the stamp material holder 22. Also, the pressing state of the thermal head 4 on the stamp material 21 of the medium 20 is a state shown in FIG. 8B in which, in addition to the pressing portions 4*a* of the thermal head 4 in which the heat-generating units are arranged, the driver IC 4*b* disposed in the vicinity of the heat-generating units is also pressed into the stamp material 21.

When the medium 20 is conveyed even further in the +X direction while forming the stamp face of the stamp material 21, as shown in FIG. 8C, the thermal head 4 reaches the end of the stamp material 21 in the −X direction (finishing end), and passes across the boundary portion between the stamp material 21 and the stamp material holder 22. At this time, the end of the stamp material holder 22 of the medium 20 in the direction of conveyance (+X direction) reaches at least the exit hole 10*d*, and the plurality ribs 10*f* provided on the inner face 10*e* of the exit hole 10*d* come into contact with the rear surface (surface on the side opposite to the surface where the stamp face is formed to which the thermal head 4 is pressed; lower surface in drawing) in the vicinity of the end of the stamp material holder 22, thus supporting the medium 20.

Here, as described above, the stamp material 21 protrudes more in the thickness direction than the stamp material holder 22, and thus, the boundary portion has a step. The driver IC 4*b* is disposed in the vicinity of the pressing portion 4*a* of the thermal head 4 (−X direction). In addition, the thermal head 4 is pressed strongly against the stamp material 21, and thus, by the thermal head 4 passing over the above-mentioned boundary portion, first, the driver IC 4*b* of the thermal head 4 drops over the step. At this time, the pressure by the driver IC 4*b* of the thermal head 4 onto the medium 20 (stamp material 21) is temporarily removed, and as shown in the arrow F in FIG. 8C, a force causing the medium 20 to rotate results (the +X direction edge is pressed downward and the −X direction edge is pressed upward).

In a configuration in which ribs 10*b* used in the present embodiment are not provided in the exit hole 10*d* of the printer 1, the medium 20 is not supported on the edge thereof in the +X direction, and thus, when the driver IC 4*b* of thermal head 4 drops at the step between the stamp material 21 and the stamp material holder 22, a force F applied on the medium 20 causes the medium 20 to rotate and tilt with respect to the path of conveyance due to a torque generated thereby, thus causing a change in the speed at which the medium 20 is fed (feeding speed) by the platen roller 12. Thus, there are cases in which printing unevenness (recesses extending in a line along the Y direction, for example) occurs due to the change in the speed at which the medium 20 is fed by the platen roller 12 in the main surface 21*a* of the stamp material 21 onto which the stamp face is formed, resulting in a stamp face not being formed as appropriate.

As a countermeasure, in the present embodiment, as shown in FIGS. 2A, 2B, and 4B, the plurality of ribs 10*f* (protruding members) are formed on the lower inner face 10*e* of the exit hole 10*d* such that the upper surface thereof touches the extension line EL drawn from the inclined surface 14*a*, which is the path of conveyance for the medium 20 conveyed during formation of the stamp face. As a result, the medium 20 is supported on the path of conveyance by the inclined surface 14*a*, the platen roller 12, and the plurality of ribs 10*f* provided on the exit hole 10*d*. Therefore, when the driver IC 4*b* of the thermal head 4 drops at the step between the stamp material 21 and the stamp material holder 22, the force F on the medium 20 is prevented from causing the medium 20 to rotate and be inclined with respect to the path of conveyance due to a counteracting force from the plurality of ribs 10*f* (shown in the arrow G in FIG. 8C), and thus, appropriate stamp face formation is performed.

When the medium 20 is conveyed further along the +X direction and formation of the stamp face in the medium 20 is complete, the medium 20 is expelled from the printer 1 through the exit hole 10*d*. Then, the control unit 2 stops the platen roller 12 by stopping the stepping motor 9 and stops the series of stamp face formation operations. The time at which the stepping motor 9 is stopped by the control unit 2 is set to be after a certain amount of time has elapsed since the rear end of the medium 20 has passed the sensor 3, for example.

In this manner, in the present embodiment, the plurality of ribs 10*f* are provided on the side of the thermal head 4 or the platen roller 12 towards which the medium 20 is conveyed (+X direction; exit hole 10*d* in the present embodiment) in the stamp face forming device that forms a stamp face in the stamp material 21 by selectively heating respective heat-generating units in the thermal head 4 while causing the thermal head 4 to move relative to the stamp material 21 while the thermal head 4 is pressed onto the stamp material 21 at a preset pressing weight (pressing force). As a result, according to the present embodiment, while forming the stamp face, the rotation of the medium 20 resulting from a change in pressing state resulting when the driver IC 4*b* of the thermal head 4 passes over the step in the boundary portion between the stamp material 21 and the stamp material holder 22 is mitigated, and the speed at which the medium 20 is fed (feeding speed) by the platen roller 12 can be kept constant, and thus, appropriate stamp face formation can be performed on the stamp material 21.

In the embodiment above, a configuration was described in which the plurality of ribs 10*f* are disposed on the lower inner face 10*e* of the exit hole 10*d* such that the medium 20 does not warp during formation of the stamp face, and more preferably, the plurality of ribs 10*f* support the medium 20 while lightly touching it with little friction, but the present invention is not limited to this configuration. That is, as long as the medium 20 is supported while satisfying the conditions above during stamp face formation, the stamp face forming device (printer 1) of the present invention may have a configuration in which a plurality of protruding members having a curved upper surface that contacts the medium 20 such as a plurality of semispherical members are provided, or a configuration in which protruding members or the like that connect in the direction perpendicular (Y direction; width direction of medium 20) to the direction of conveyance of the medium 20 (X direction) are provided. Also, the ribs or protruding members are not limited to a configuration in which they protrude from the lower inner face 10*e* of the exit hole 10*d*, and may be disposed in an appropriate location in the printer 1 (position touching the extension line EL from the inclined surface 14*a* shown in FIG. 4B). According to this configuration, as described above, even if the sizes of the media 20 differ depending on the sizes of the stamp materials 21 (vertical dimension in FIG. 6A), it is possible to convey the medium 20 while reliably supporting it while contacting the medium 20 to an appropriate degree, and an appropriate stamp face can be formed.

Also, in the embodiment above, a configuration was described in which the X direction is the direction of movement of the stamp material 21 and the thermal head 4 is fixed in the X direction, but another configuration may be used as long as the stamp face is formed in the stamp material 21 with the thermal head 4 moving relative to the stamp material 21 while pressing down on the stamp material 21. For example, a configuration in which the thermal head 4 moves in the X direction and the stamp material 21 is fixed in the X direction, or a configuration in which the thermal head 4 and the stamp material 21 both move in the X direction may be used.

Also, in the embodiment above, a configuration was described in which a platen roller 12 is used as the conveyance mechanism for conveying the stamp material 21, but a moveable table onto which the stamp material 21 is mounted may be used as the conveyance mechanism.

Also, in the embodiment above, a case was described in which the length of the cutout 22*a* of the medium 20 is detected by the sensor 3 to determine the type of the medium 20 (size of the stamp material 21), but the type of medium 20 may be determined by providing an identifier (such as a barcode or an IC tag) on the medium 20 and reading in the identifier, or a configuration may be used in which the operator of the printer 1 directly inputs the type of medium 20 prior to stamp face formation starting.

A preferred embodiment of the present invention was described above, but the present invention is not limited to specific embodiments, and the invention disclosed in the claims and an equivalent thereof are encompassed in the present invention.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A device for forming a stamp face, comprising:

a stamp face forming unit configured to press a stamp material held in a stamp material holder to form the stamp face in the stamp material;

a conveying unit configured to move the stamp material holder relative to the stamp face forming unit along a conveyance path; and a support unit configured to support the stamp material holder in such a way as to cancel out a torque generated by a force applied by the stamp face forming unit to the stamp material holder that would cause the stamp material holder to tilt with respect to the conveyance path for the stamp material holder, at least when the stamp face is being formed, wherein the support unit includes a plurality of support members, and wherein the plurality of support members are provided along a direction perpendicular to a direction of relative movement of the stamp material holder to be used in the device.

2. The device according to claim 1, wherein the stamp face forming unit is a thermal head having therein a plurality of heat-generating units arranged in a direction perpendicular to a direction of relative movement of the stamp material holder and parallel to a surface of the stamp material holder in which the stamp material is held, the thermal head being provided with a driver circuit for controlling a heating state of the plurality of heat-generating units, the driver circuit being proximal to the plurality of heat-generating units, and wherein the stamp material is a porous material having thermosetting properties such that heat applied by the plurality of heat-generating units causes the stamp material to become non-porous.

3. The device according to claim 1, wherein the stamp material to be used in the device is attached to the stamp material holder to be used in the device such that a main surface of the stamp material where the stamp face is to be formed protrudes in a direction of thickness from a surface of the stamp material holder on which the stamp material is not held.

4. The device according to claim 1, wherein a step is present between a main surface of the stamp material to be used in the device and a surface of the stamp material holder, to be used in the device, on which the stamp material is not being held, and wherein the support unit supports the stamp material holder in such a way as to cancel out said torque generated due to the step when the stamp material holder moves relative to the stamp face forming unit.

5. The device according to claim 1, wherein the support unit is provided in an exit hole for the stamp material holder to be used in the device in a device case.

6. The device according to claim 1, wherein the plurality of support members are provided on a front side of the stamp material holder, said front side being defined as a side to which the stamp material holder moves relative to the stamp face forming unit before the stamp material held in the stamp material holder is pressed.

7. A method of forming a stamp face, comprising:

pressing a stamp material held in a stamp material holder using a stamp face forming unit to form the stamp face in the stamp material;

conveying the stamp material holder to move relative to the stamp face forming unit along a conveyance path when pressing the stamp material; and supporting the stamp material holder by a support unit in such a way as to cancel out a torque generated by a force applied by the stamp face forming unit to the stamp material holder that would cause the stamp material holder to tilt with respect to the conveyance path for the stamp material holder, at least when the stamp face is being formed, wherein the support unit includes a plurality of support members, and wherein the plurality of support members are provided along a direction perpendicular to a direction of relative movement of the stamp material holder.

8. The method of forming a stamp face according to claim 7, wherein, in pressing the stamp material, the stamp face is formed in the stamp material by a thermal head having therein a plurality of heat-generating units arranged in a direction perpendicular to a direction of relative movement of the stamp material holder and parallel to a surface of the stamp material holder in which the stamp material is held, the thermal head being provided with a driver circuit for controlling a heating state of the plurality of heat-generating units, the driver circuit being proximal to the plurality of heat-generating units, and wherein the stamp material is a porous material having thermosetting properties such that heat applied by the plurality of heat-generating units causes the stamp material to become non-porous.

9. The method of forming a stamp face according to claim 7, wherein a main surface of the stamp material where the stamp face is to be formed protrudes in a direction of thickness from a surface of the stamp material holder where the stamp material is not held.

10. The method of forming a stamp face according to claim 7, wherein a step is present between a main surface of the stamp material and a surface of the stamp material holder on which the stamp material is not being held, and wherein the support unit supports the stamp material holder in such a way as to cancel out said torque generated due to the step when the stamp material holder moves relative to the stamp face forming unit.

11. The method of forming a stamp face according to claim 10, wherein the support unit is provided in an exit hole for the stamp material holder in a device case.

12. A non-transitory storage medium storing therein a program to be read by a computer processor included in a stamp face forming device, said stamp face forming device including: said computer processor; a stamp face forming unit configured to press a stamp material held in a stamp material holder to form the stamp face in the stamp material; a conveying unit configured to move the stamp material holder relative to the stamp face forming unit along a conveyance path; and a support unit configured to support the stamp material holder in such a way as to cancel out a torque generated by a force applied by the stamp face forming unit to the stamp material holder that would cause the stamp material holder to tilt with respect to the conveyance path for the stamp material holder, at least when the stamp face is being formed, the program causing the computer processor to control the stamp face forming device so as to perform the following process:

pressing the stamp material held in the stamp material holder using the stamp face forming unit to form the stamp face in the stamp material;

conveying, via the conveying unit, the stamp material holder to move relative to the stamp face forming unit along a conveyance path when pressing the stamp material; and supporting the stamp material holder by the support unit in such a way as to cancel out the torque generated by the force applied by the stamp face forming unit to the stamp material holder that would cause the stamp material holder to tilt with respect to the conveyance path for the stamp material holder, at least when the stamp face is being formed, wherein the support unit includes a plurality of support members, and wherein the plurality of support members are provided along a direction perpendicular to a direction of relative movement of stamp material holder.

13. The non-transitory storage medium according to claim 12, wherein, in pressing the stamp material, the stamp face is formed in the stamp material by a thermal head having therein a plurality of heat-generating units arranged in a direction perpendicular to a direction of relative movement of the stamp material holder and parallel to a surface of the stamp material holder on which the stamp material is held, the thermal head being provided with a driver circuit for controlling a heating state of the plurality of heat-generating units, the driver circuit being proximal to the plurality of heat-generating units, and wherein the stamp material is a porous material having thermosetting properties such that heat applied by the plurality of heat-generating units causes the stamp material to become non-porous.

14. The non-transitory storage medium according to claim 12, wherein a main surface of the stamp material where the stamp face is to be formed is attached to the stamp material holder so as to protrude in a direction of thickness from a surface of the stamp material holder on which the stamp material is not held.

15. The non-transitory storage medium according to claim 12, wherein a step is present between a main surface of the stamp material and a surface of the stamp material holder on which the stamp material is not being held, and wherein, in supporting the stamp material holder, the support unit supports the stamp material holder in such a way as to cancel out said torque generated due to the step when the stamp material holder moves relative to the stamp face forming unit.

16. The non-transitory storage medium according to claim 15, wherein the support unit is provided in an exit hole for the stamp material holder in a device case.

* * * * *